US005893410A

United States Patent [19]

Halbrook

[11] Patent Number: 5,893,410

[45] Date of Patent: Apr. 13, 1999

[54] FALLING FILM CONDENSING HEAT EXCHANGER WITH LIQUID FILM HEAT TRANSFER

[75] Inventor: Nicholas Dinkel Halbrook, Kenansville, N.C.

[73] Assignee: General Electric Co., Schenectady, N.Y.

[21] Appl. No.: 08/871,786

[22] Filed: Jun. 9, 1997

[51] Int. Cl.[6] ..... F28D 3/02

[52] U.S. Cl. ..... 165/118; 165/DIG. 172; 261/112.1; 261/153

[58] Field of Search ..... 165/115, 118, 165/DIG. 172; 261/112.1, 153

[56] References Cited

U.S. PATENT DOCUMENTS

| | | | |
|---|---|---|---|
| 724,511 | 4/1903 | Schutt | 122/34 |
| 1,906,450 | 5/1933 | Demers | 165/118 X |
| 2,944,966 | 7/1960 | Eickmeyer | 165/118 X |
| 3,227,630 | 1/1966 | Beckman | 202/205 |
| 3,271,969 | 9/1966 | Lorentzen | 62/98 |
| 3,292,998 | 12/1966 | James | 165/118 |
| 3,795,388 | 3/1974 | Toth | 261/112.1 |
| 4,235,281 | 11/1980 | Fitch et al. | 165/118 X |
| 4,477,396 | 10/1984 | Wilkinson | 261/112.1 |
| 4,520,866 | 6/1985 | Nakajima et al. | 165/115 |
| 4,532,985 | 8/1985 | Cutler | 165/118 |
| 4,641,706 | 2/1987 | Haynie | 165/118 |

*Primary Examiner*—Allen Flanigan
*Attorney, Agent, or Firm*—Nixon & Vanderhye

[57] ABSTRACT

The falling film condensing heat exchanger includes a plurality of vertical tubes carrying a coolant. A distribution plate is disposed at the upper end of the condenser shell and has a plurality of apertures receiving the tubes. The apertures in the distribution plate define an annular space around the tubes which permits liquid to flow through the distribution plate apertures in the form of a thin film about the tubes below the distribution plate to enhance heat transfer between the vapor on the shell side and the coolant on the tube side. The distribution plate has depressions about each of the apertures to puddle the liquid, ensuring flow of liquid through the apertures in the form of a thin film about the surface of each tube.

12 Claims, 4 Drawing Sheets

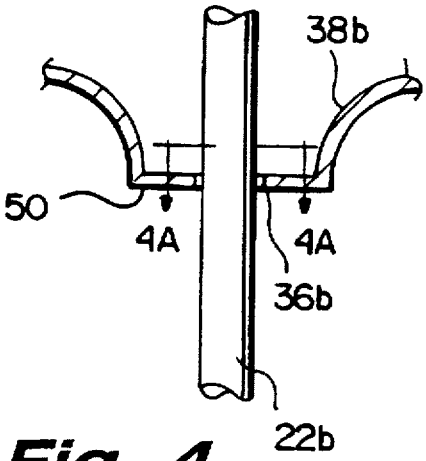
Fig. 4
Fig. 4A
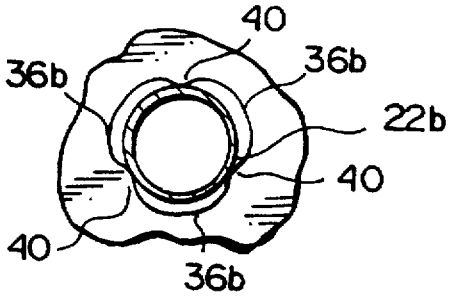
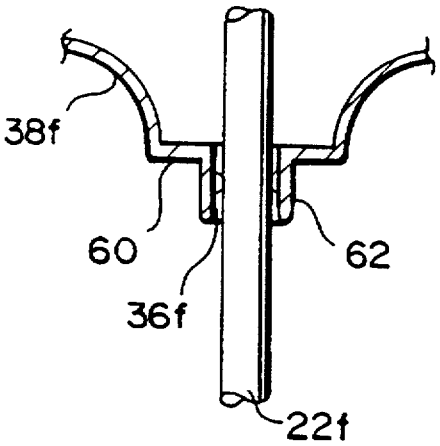
Fig. 8
Fig. 5
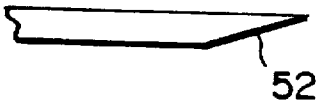
Fig. 6
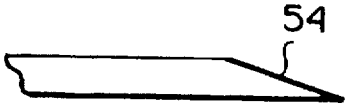
Fig. 7
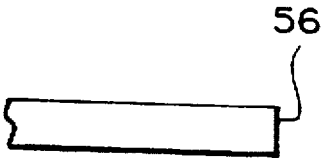

FALLING FILM CONDENSING HEAT EXCHANGER WITH LIQUID FILM HEAT TRANSFER

TECHNICAL FIELD

The present invention relates to a condensing heat exchanger and particularly relates to a condenser employing a falling liquid film about heat exchanger tubes carrying a coolant to enhance heat transfer between the vapor being condensed and the coolant.

BACKGROUND

There are many and various types of falling film condensing heat exchangers, hereinafter referred to as condensers. Wide variations in the heat exchange performance of these condensers can be attributed, at least in part, to incomplete, non-uniform and unstable formation of a liquid film about the tubes containing the coolant. That is, the external surfaces of every tube containing the coolant does not have a continuous, uniform coating of liquid film on the shell side along its entire length. Rather, those surfaces at the upper (vapor inlet) end of the heat exchanger and immediately below each support plate are exposed directly to the vapor being condensed, resulting in poor heat transfer capacity. Liquid, of course, conducts heat better than a vapor. Consequently, the lack of a continuous top to bottom thin film of liquid about the coolant carrying tubes within the condenser precludes effective realization of high, theoretically possible overall heat transfer coefficients which would otherwise enable a substantial reduction in heat exchange surface area for a given condensing duty. A direct result of this failure is the necessity to provide large heat transfer areas (the coolant/vapor interface) which substantially increases the cost of a condenser for a given condensing duty. In short, the problem associated with prior falling film condensing heat exchangers is the failure to establish a uniform liquid film on the coolant carrying condensing tubes as the vapor phase condenses about the tubes, especially at the vapor inlet end of the tubes and the maintenance of this film as the tubes pass through support plates located axially along their length.

DISCLOSURE OF THE INVENTION

In accordance with the present invention, there is provided a falling film condensing heat exchanger which establishes and maintains in a controlled manner a uniform liquid film or coating about the exterior surfaces, i.e., on the shell side, of all of the coolant tubes of a coolant tube bundle in a vertical falling film condensing heat exchanger along the entire length of each tube. This enables beneficial use of the high, theoretically possible overall heat transfer coefficients and a consequent substantial reduction in heat exchange surface area required for a given condensing duty. Because cost is a direct function of the area necessary in a condenser for a given condensing duty, large cost savings can be realized by the controlled establishment and maintenance of a uniform thin film of liquid about the shell side of all tubes along the entire length of the tube bundle in a falling film condensing heat exchanger.

Particularly, a uniform liquid film about each of the coolant carrying tubes throughout substantially their entire length is obtained by providing a distribution plate at the upper end of the condenser shell, the shell having a plurality of apertures for receiving the coolant carrying tubes. The tubes are centered within the apertures at spaced circumferential positions about the apertures, leaving a substantially annular space between the margins of the apertures and the exterior surfaces of the tubes. By flowing a liquid into a chamber above the distribution plate, the liquid flows through the annular space defined by the apertures and the coolant tubes, forming a substantially uniform thickness liquid film about the tubes as the liquid progresses downwardly along the tubes. Below the distribution plate, a vapor inlet is provided for flowing vapor, typically steam, or a binary fluid such as steam and ammonia, for condensing the vapor into a liquid. By having the vapor contact the liquid film about the coolant carrying tubes along their entire length, high heat transfer coefficients between the coolant and vapor are obtained with consequent increased heat transfer efficiency. Thus, the liquid introduced on the upper side of the distribution plate flows downwardly through the apertures, thereby coating the tubes with a thin liquid film having a controlled established uniform thickness. Preferably, the distribution plate is depressed in the areas of the apertures so that the liquid above the distribution plate will puddle in the depressed areas and about the aperture containing the coolant carrying tube. Different aperture designs may be provided. For example, each depressed area may terminate at its lower end in a horizontally extending flange having a depending stub tube coaxial with the coolant carrying tube to define a uniform thin film thickness about the tube for flow downwardly along the tube in contact with the vapor. Alternatively, horizontal edges about the apertures may be tapered to provide a sharply delineated liquid film about the tube. The apertures through the distribution plate can be punched or extruded, the plate being formed of metal or plastic as desired.

In a preferred embodiment of the present invention, there are provided a plurality of distribution plates having apertures therethrough receiving the tubes at various elevations along the condenser. The distribution plates at the various elevations are staggered with respect to one another. This provides a circuitous flow of the vapor on the shell side while the liquid from the condensed vapor above each of the laterally limited staggered distribution plates flows through the apertures forming a thin film on the tubes just below each such distribution plate. These plates perform two functions. They provide support for the tubes along their length and they provide a means to maintain in a controlled manner the liquid film as the tubes pass through these supporting plates.

In a preferred embodiment according to the present invention, there is provided a condenser comprising a condenser shell, a plurality of tubes within and extending between upper and lower ends of the shell for conveying a coolant between the ends, an inlet for flowing a vapor to be condensed into the shell and in and about the tubes, a distribution plate located in the shell above the vapor inlet and having a plurality of apertures completely surrounding the tubes adjacent the upper end of the shell and an inlet for flowing liquid into the shell above the plate and through the apertures, the liquid flowing through the apertures flowing along the exterior surfaces of portions of the tubes below the distribution plate to establish a falling film of liquid adherent to and about each of the tubes and thereby facilitate heat exchange between the vapor and the coolant thereby to condense the vapor.

In a further preferred embodiment according to the present invention, there is provided a condenser comprising a condenser shell, a plurality of tubes within and extending between upper and lower ends of the shell for conveying a coolant between the ends, an inlet for flowing a vapor to be condensed into the shell and in and about the tubes, a plurality of distribution plates located at different elevations within the shell, with at least one distribution plate located in the shell above the vapor inlet, each distribution plate having a plurality of apertures therethrough completely surrounding tubes passing through the apertures with the one distribution plate having a number of apertures equal to the number of tubes, an inlet for flowing liquid into the shell above the one distribution plate and through the apertures thereof, the liquid flowing through the apertures flowing along the exterior surfaces of portions of the tubes below the one distribution plate to establish a falling film of liquid adherent to and about each of the tubes and thereby facilitate heat exchange between the vapor and the coolant whereby the vapor is condensed to liquid, at least part of the liquid formed from the condensed vapor and at least part of the film of liquid formed on the tube portions above each distribution plate below the one distribution plate being combined and passed through the apertures thereof to form a thin film about tube portions below the distribution plates other than the one distribution plate.

Accordingly, it is a primary object of the present invention to provide a novel and improved falling film condensing heat exchanger which establishes and maintains in a controlled manner a uniform liquid film or coating about the shell side of all of the coolant carrying tubes and along the entire length of each tube to maximize overall heat transfer coefficients, enabling a reduction in heat exchange surface area for a given condensing duty.

BRIEF DESCRIPTION OF THE DRAWINGS

FIG. 4 is an enlarged view of a depression in the distribution plate illustrating the aperture and tube passing through the aperture;

FIG. 4A is a cross-sectional view thereof taken generally about on line 4A—4A of FIG. 4;

FIGS. 5, 6 and 7 are fragmentary enlarged views of the aperture lips of the various forms of the apertures; and FIG. 8 is a view similar to FIG. 4 illustrating a further form of aperture.

BEST MODE FOR CARRYING OUT THE INVENTION

Figure 1:
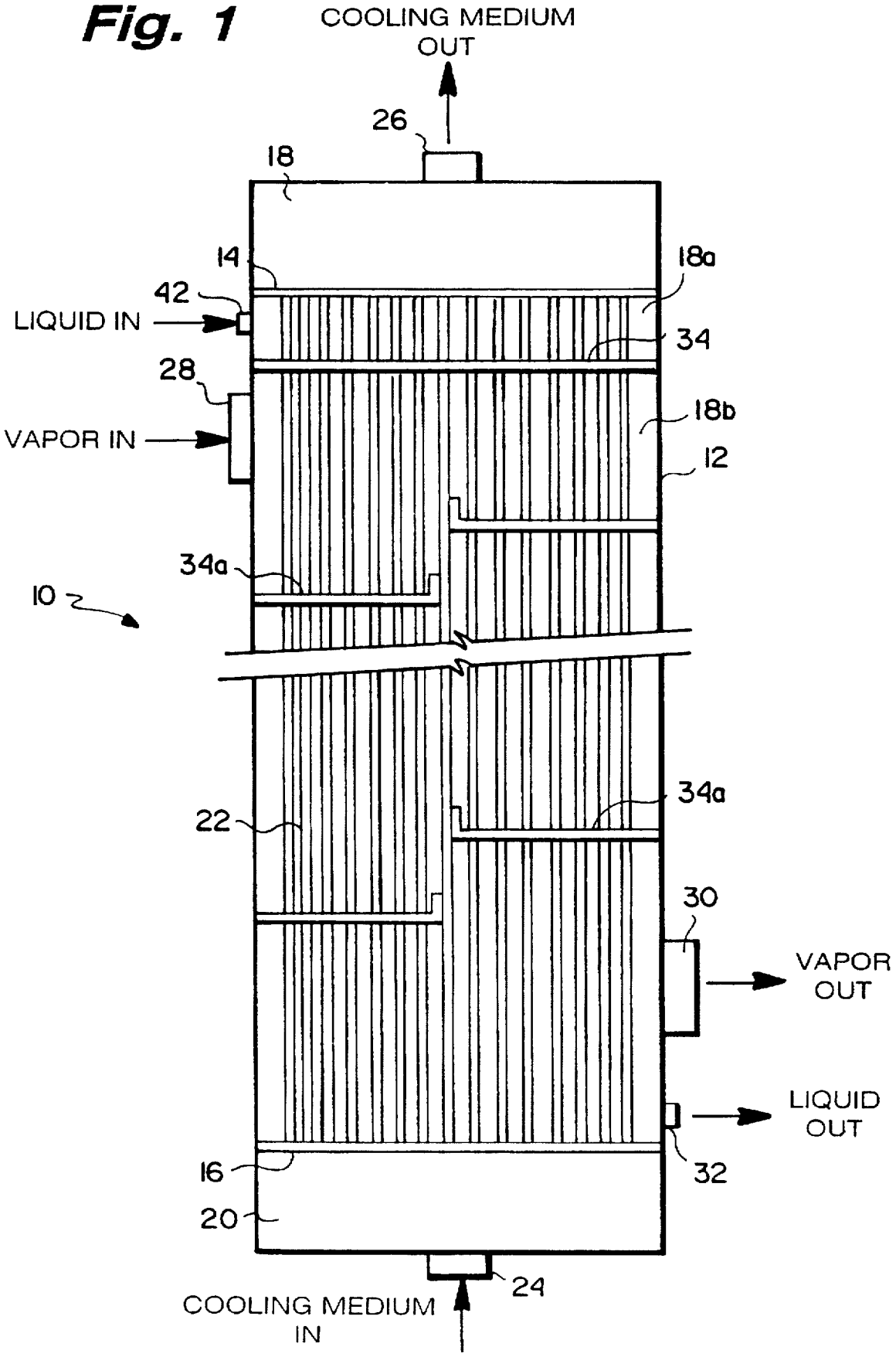
FIG. 1 is a schematic illustration of a falling film condensing heat exchanger according to the present invention.

Referring now to the drawings, particularly to FIG. 1, there is illustrated a falling film condensing heat exchanger, i.e., a condenser, generally designated 10, comprised of an outer shell 12 having upper and lower tube sheets 14 and 16, respectively, defining chambers 18 and 20 at respective upper and lower ends of the shell 12. A plurality of tubes 22 extend between the tube sheets 14 and 16 and open into the chambers 18 and 20. A cooling medium inlet 24 is disposed at the bottom of the shell 12 and a cooling medium outlet 26 is disposed at the top of the shell. Thus, cooling medium, such as water, flowing into the inlet 24 flows into chamber 20 and upwardly through the tubes 22 into the chamber 18 for flow out of the chamber 18 through outlet 26.

It will be appreciated that the shell 12 may have any cross-sectional configuration and preferably the shell is a cylinder for confining the vapor which flows in and about the tubes 22 for purposes of condensing the vapor. The shell 12 also has one or more vapor inlets 28 located circumferentially around shell 12 adjacent the upper end of the condenser 10 and may have a vapor outlet 30 for flowing uncondensed vapor out of the condenser 10. A liquid outlet 32 is provided adjacent the lower end of the condenser body 12 to provide for outflow of condensed liquid from the condenser 10.

Figure 2:
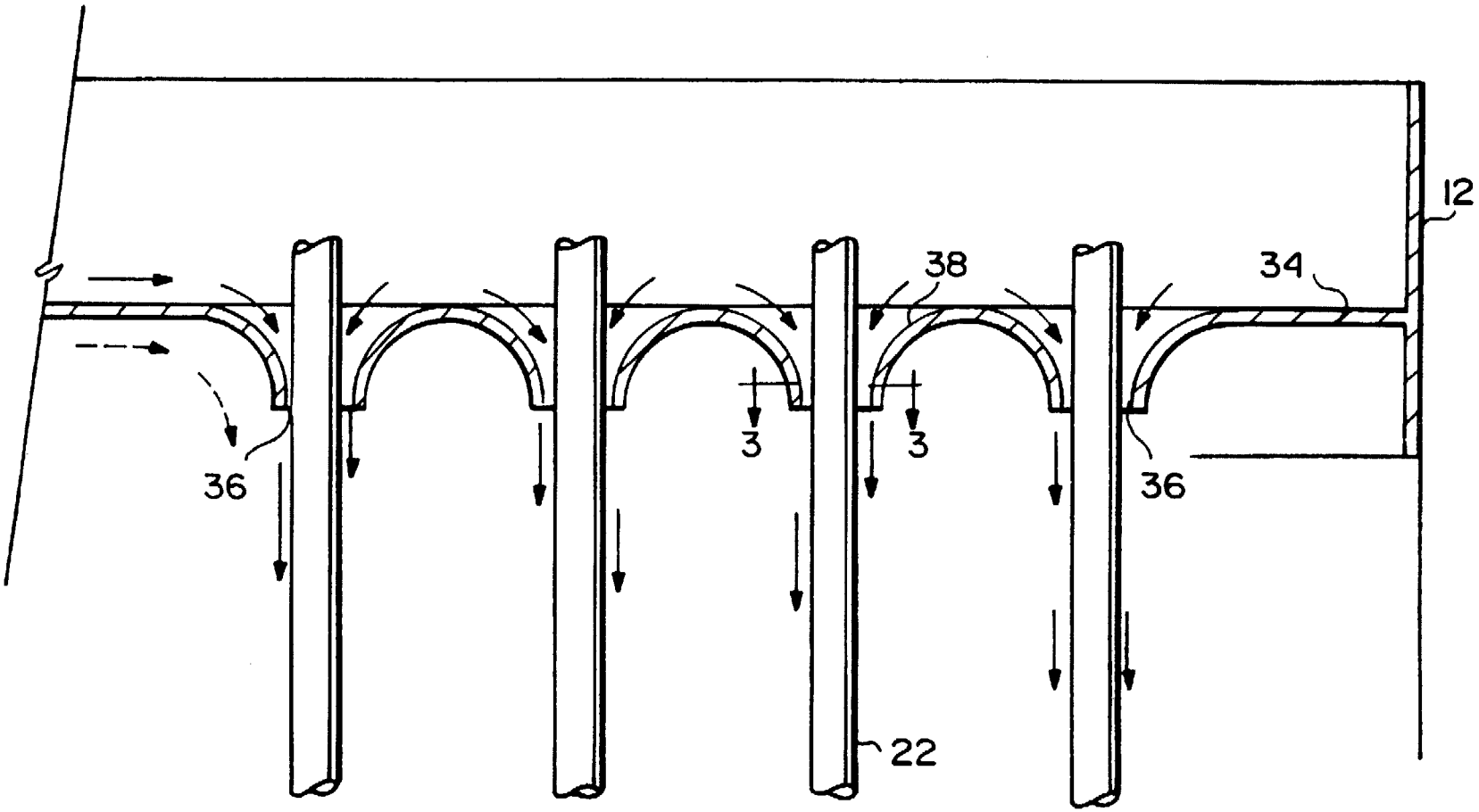
FIG. 2 is an enlarged fragmentary cross-sectional view of a distribution plate used in the condenser hereof.

In accordance with the present invention, the distribution plate 34 is disposed adjacent the upper end of shell body 12 below the upper tube sheet 14. Distribution plate 34 extends across the entire diameter of cylindrical body 12 and has a plurality of apertures 36 (FIG. 2) for receiving the tubes 22. As illustrated in FIG. 2, each of the apertures 36 is formed in a depressed region 38 of the distribution plate 34. That is, the distribution plate 34 extends horizontally and has a series of depressions 38 which terminate in apertures 36 about tubes 22. The depressions 38 form regions where liquid can puddle above distribution plate 34 and thus flow downwardly through the apertures 36 to form a thin uniform film about the external surfaces of the tubes 22, i.e., on the shell side of the tubes.

Figure 3:
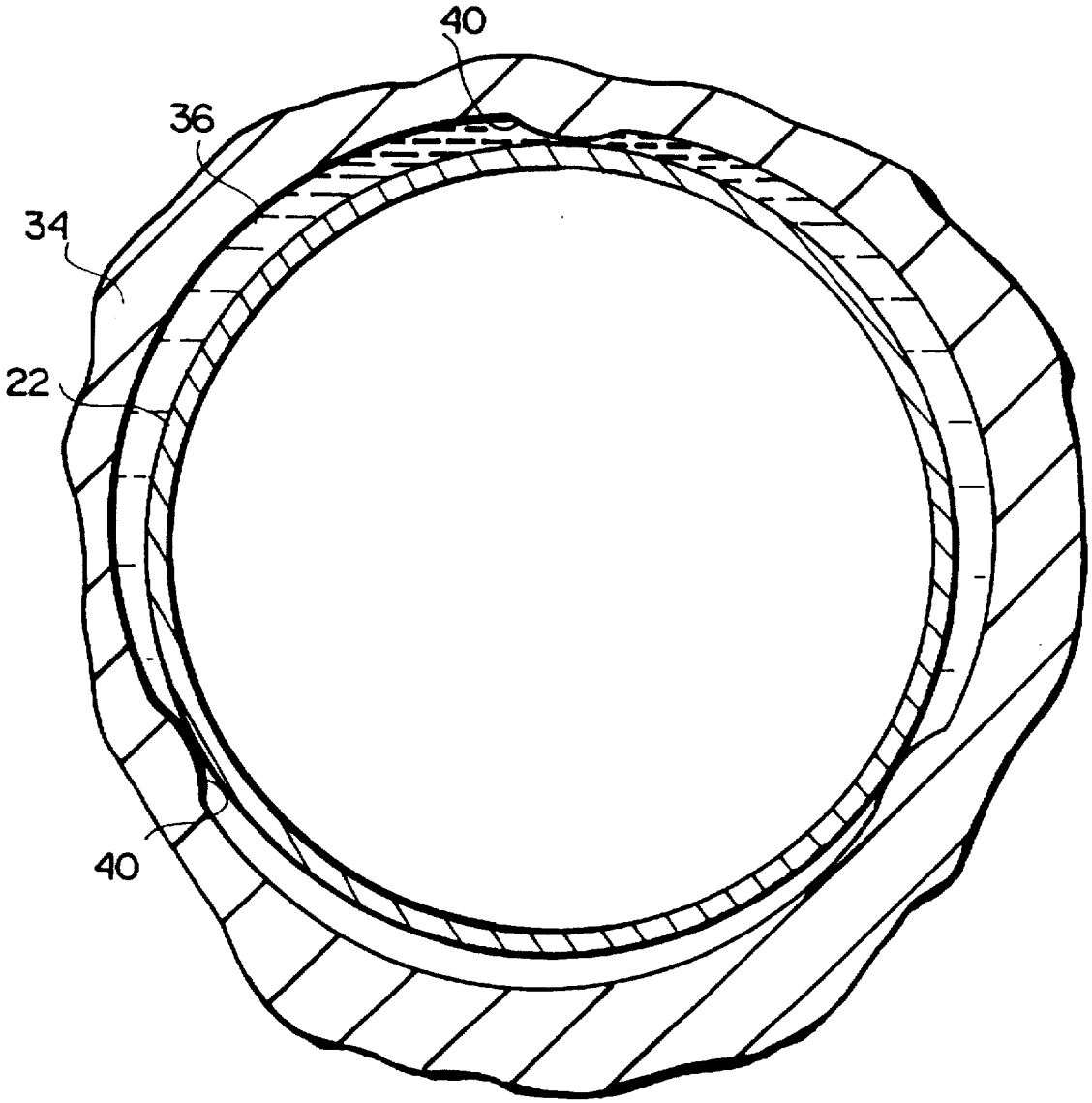
FIG. 3 is an enlarged cross-sectional view taken generally about on line 3—3 in FIG. 2.

As illustrated in FIGS. 2 and 3, the margins of the distribution plate 34 forming the apertures 36 are spaced from the exterior surfaces of the tubes 22 to define generally annular areas about tubes 22 through which liquid may flow downwardly, as indicated by the arrows in FIG. 2. The tubes 22 are centered in the apertures 36 by radially inwardly extending projections 40 (FIG. 3) at spaced circumferential positions about the apertures 36. Also provided above the distribution plate 34 is one or more liquid inlets 42 located circumferentially around shell 12 for flowing a liquid into a chamber above the distribution plate 34 and about the upper ends of tubes 22. The liquid thus flows across the distribution plate 34 and into the depressed regions to form puddles and ultimately flows through the apertures 36 in a generally annular configuration forming a thin film of liquid about the external surfaces of tubes 22. The entire volume of the shell side chamber **18*a* between the distribution plate 34 and the upper tube sheet 14 may become filled with the liquid entering through inlet 42 and may be at about the same pressure as or at a greater pressure than the vapor entering through 28**.

In operation, coolant, e.g., water, flows into the tubes 22 in shell 12 by way of inlet 24, the coolant passing through the tubes 22 and out of the shell via outlet 26. Vapor, for example, steam or a binary vapor, i.e., steam and ammonia, enters the shell 12 via the vapor inlet(s) 28 at a location below the distribution plate 34. Liquid also flows into the shell 12 through the liquid inlet(s) 42 for forming the thin film about the external surfaces of tubes 22. As the liquid flows horizontally above distribution plate 34, it flows into the depressed regions about the apertures 36 and forms by flowing through the apertures a thin film of uniform thickness about each of the tubes 22 for flow downwardly below distribution plate 34 in heat transfer relation with the vapor supplied via inlet(s) 28 on the shell side of the tubes 22. With coolant flowing through the tubes 22 and the thin film of liquid flowing about the external surfaces of tubes 22, efficient heat transfer takes place across the thin film of liquid on the tubes between the vapor and the coolant carried by the tubes whereby the vapor is condensed into a liquid for flow via the falling liquid film surrounding the external surface of the tubes 22 toward the bottom of the shell 12.

As a specific example, the coolant flowing through the tubes 22 may comprise water flowing into the condenser at a temperature within a range of about 55–85° F. The liquid flowing into the shell 12 above distribution plate 34 via inlet 42 may also comprise water, for example, at a temperature in a range of 120–200° F. With this arrangement, the vapor entering the shell via inlet(s) 28 is condensed and flows out of the shell at outlet(s) 32 at a temperature within a range of approximately 100–180° F. The temperature of the coolant at the outlet 26 may lie within a range of 85–95° F.

Referring back to FIG. 1, a preferred form of the present invention provides a single distribution plate 34 adjacent the upper end of the condenser and which distribution plate extends from side to side so that all liquid flowing into shell 12 through inlet(s) 42 must flow through the apertures and about the tubes 22. Below the distribution plate 34 and at different elevations along the height of the condenser shell 12, a plurality of distribution plates 34*a* may also be disposed in the shell 12. Each distribution plate 34*a* extends only part-way in a horizontal direction across the shell and has the same depressions and apertures as described above with respect to distribution plate 34 for receiving the tubes. For example, each distribution plate 34*a* may comprise a semi-circular plate having apertures 36 and depressions 38 similarly as the full circular plate 34. The distribution plates 34*a* are also staggered relative to one another along opposite sides of the shell at the different elevations. As a consequence of this arrangement, the vapor flowing into shell 12 may flow in a circuitous, generally sinuous path from top to bottom. Importantly, at each level of the distribution plate 34*a*, the thin film about the tubes above distribution plate 34*a*, together with the condensed liquid from the vapor in that region tend to puddle in the depressed regions 38 of the plate 34*a* and are reconstituted for thin film flow downwardly through the apertures 36 of that distribution plate about the external surfaces of the tubes 22. The clearance between the individual tubes 22 and the respective distribution plate depression hole 36 may increase as the plate 34*a* distance from the top of the shell 12 increases in order to accommodate the increased volumetric flow resulting from condensation of the vapor. Alternately, the apertures 36 may remain constant and the excess condensate can cascade downwardly over the edge of the partial distribution plate which may or may not be provided with a dam, e.g., a vertical lip projecting above the top surface of the plate.

Referring now to FIG. 4, there is illustrated a preferred form of depression wherein the apertures 36*b* are formed by horizontal flanges 50 forming the bottom of the depressions 38*b*. Thus, the flanges 50 extend at right angles to the axial extent of the tubes 22*b*. The annular areas between the margins of the flanges 50 and the tubes define the thickness of the film of liquid flowing downwardly along the external surfaces of the tubes.

Various forms of the edges for the flanges 50 are illustrated in FIGS. 5, 6 and 7. Preferably, the edges are tapered radially outwardly and downwardly as illustrated at 52 in FIG. 5, thereby defining a sharp predetermined uniform film thickness. It will be appreciated, however, that other configurations such as a reverse taper, where the taper is radially inward and downward as illustrated at 54 in FIG. 6, may also be used. A squared edge 56 as illustrated in FIG. 7 may also be provided.

Referring to FIG. 8, a further form of distribution plate is illustrated. In this form, the depression 38*f* terminates in a horizontally directed flange 60. A stub tube 62 extends from the flanges 60 and forms a short sleeve defining the annular aperture 36*f* between tube 62 and tube 22*f*.

Each of the aperture designs provides a stable and uniform separation of the liquid from the distribution plate without upsetting adherence of the film to the tube. The specific aperture edge design to be used would be a function of the physical properties of the particular fluid being condensed and the attendant system operating conditions.

In summary, it will be appreciated that the existence of a liquid film or coating about the exterior surface of each of the coolant carrying tubes 22 affords a very high heat transfer rate between the vapor and coolant, enabling a reduction in the heat exchange surface area required for a given condensing duty. The distribution plate or plates thus ensure the uniform establishment of the liquid film throughout the length of the coolant carrying tubes enabling effective use of high heat transfer coefficients. As a consequence, the size of the condenser can be reduced for a given condensing duty thereby obtaining substantial cost savings for the condensing duty required.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A condenser comprising:

a condenser shell;

a plurality of tubes within and extending between upper and lower ends of said shell for conveying a coolant between said ends;

an inlet for flowing a vapor to be condensed into said shell and about said tubes;

a distribution plate located in said shell above said vapor inlet and having a plurality of apertures surrounding said tubes adjacent the upper end of said shell; and an inlet for flowing liquid into said shell above said plate and through said apertures, the liquid flowing through the apertures flowing along the exterior surfaces of said tubes below said distribution plate to establish a falling film of liquid adherent to and about each of said tubes and thereby facilitate heat exchange between the vapor and the coolant thereby to condense the vapor;

said distribution plate having a plurality of depressions surrounding said tubes, respectively, for puddling liquid about the tubes and terminating in said apertures, edges of said depressions in said distribution plate about said tubes being larger in diameter than the diameter of the tubes passing through said apertures thereby defining a substantially annular flow of liquid through each aperture and an annular liquid film about the tube passing through the aperture.

2. A condenser according to claim 1 wherein said apertures are defined in part by radially inwardly directed flanges of said distribution plate forming said depressions and spaced radially outwardly of a tube therethrough defining an annular flow region about said tube.

3. A condenser comprising:

a condenser shell;

a plurality of tubes within and extending between upper and lower ends of said shell for conveying a coolant between said ends;

an inlet for flowing a vapor to be condensed into said shell and about said tubes;

a plurality of distribution plates located at different elevations within said shell, with one distribution plate located in said shell above said vapor inlet;

each distribution plate having a plurality of apertures therethrough surrounding tubes passing through said apertures with said one distribution plate having a number of apertures equal to the number of tubes;

an inlet for flowing liquid into said shell above said one distribution plate and through said apertures thereof, the liquid flowing through the apertures flowing along the exterior surfaces of said tubes below said one distribution plate to establish a falling film of liquid adherent to and about each of said tubes and thereby facilitate heat exchange between the vapor and the coolant whereby the vapor is condensed to liquid, at least part of the liquid formed from the condensed vapor and at least part of the film of liquid formed on the tube portions above each distribution plate below said one distribution plate being combined and passed through said apertures thereof to form a thin film about tube portions below said distribution plates other than said one distribution plate;

each of said distribution plates has a plurality of depressions surrounding said tubes, respectively, and terminating in said apertures, edges of said depressions in said distribution plate about said tubes being larger in diameter than the diameter of the tubes passing through said apertures thereby defining a substantially annular flow of liquid through each aperture and an annular liquid film about the tube passing through the aperture.

4. A condenser according to claim 3 wherein said apertures in each said distribution plate are defined in part by radially inwardly directed flanges of said distribution plate forming said depressions and spaced radially outwardly of a tube therethrough defining an annular flow region about said tube.

5. A condenser according to claim 4 wherein said flange has an edge in registration with said opening, said edge being tapered.

6. A condenser comprising:

a condenser shell;

a plurality of tubes within and extending between upper and lower ends of said shell for conveying a coolant between said ends;

an inlet for flowing a vapor to be condensed into said shell and in and about said tubes;

a distribution plate located in said shell above said vapor inlet and having a plurality of apertures surrounding said tubes adjacent the upper end of said shell; and an inlet for flowing liquid into said shell above said plate and through said apertures, the liquid flowing through the apertures flowing along the exterior surfaces of said tubes below said distribution plate to establish a falling film of liquid adherent to and about each of said tubes and thereby facilitate heat exchange between the vapor and the coolant thereby to condense the vapor;

at least one of said apertures being defined in part by a radially inwardly directed flange of said distribution plate spaced radially outwardly of a tube therethrough defining an annular flow region about said tube, said flange having an edge in registration with said opening, said edge being tapered.

7. A condenser comprising:

a condenser shell;

a plurality of tubes within and extending between upper and lower ends of said shell for conveying a coolant between said ends;

an inlet for flowing a vapor to be condensed into said shell and in and about said tubes;

a distribution plate located in said shell above said vapor inlet and having a plurality of apertures surrounding said tubes adjacent the upper end of said shell;

an inlet for flowing liquid into said shell above said plate and through said apertures, the liquid flowing through the apertures flowing along the exterior surfaces of said tubes below said distribution plate to establish a falling film of liquid adherent to and about each of said tubes and thereby facilitate heat exchange between the vapor and the coolant thereby to condense the vapor; and a second plate having a reduced lateral extent compared to said first plate and having a plurality of apertures respectively surrounding a predetermined number of said tubes for forming a thin film of liquid about the tubes passing through said second plate.

8. A condenser comprising:

a condenser shell;

a plurality of tubes within and extending between upper and lower ends of said shell for conveying a coolant between said ends;

an inlet for flowing a vapor to be condensed into said shell and in and about said tubes;

a plurality of distribution plates located at different elevations within said shell, with one distribution plate located in said shell above said vapor inlet;

each distribution plate having a plurality of apertures therethrough surrounding tubes passing through said apertures with said one distribution plate having a number of apertures equal to the number of tubes;

an inlet for flowing liquid into said shell above said one distribution plate and through said apertures thereof, the liquid flowing through the apertures flowing along the exterior surfaces of said tubes below said one distribution plate to establish a falling film of liquid adherent to and about each of said tubes and thereby facilitate heat exchange between the vapor and the coolant whereby the vapor is condensed to liquid, at least part of the liquid formed from the condensed vapor and at least part of the film of liquid formed on the tube portions above each distribution plate below said one distribution plate being combined and passed through said apertures thereof to form a thin film about tube portions below said distribution plates other than said one distribution plate;

said distribution plates below said one distribution plate having a reduced lateral extent compared to said one distribution plate and having a plurality of apertures surrounding a predetermined number of said tubes for forming a thin film of liquid about the tubes passing through said reduced distribution plates.

9. A condenser according to claim 8 wherein each said distribution plate has a plurality of depressions surrounding said tubes and terminating in said apertures thereof, edges of said depressions in each said distribution plate about said tubes being larger in diameter than the diameter of the tube passing through said apertures.

10. A condenser according to claim 8 wherein said vapor inlet is located below said one distribution plate adjacent an upper end of the condenser, and having said reduced distribution plates being staggered at different elevations relative to one another within the condenser such that the vapor from said vapor inlet follows a circuitous path from said upper end of the condenser to a lower end thereof.

11. A condenser according to claim 10 wherein each of said distribution plates has a plurality of depressions substantially surrounding each said tube and terminating in said apertures, edges of said depressions in said distribution plate about said tubes being larger in diameter than the diameter of the tubes passing through said apertures thereby defining a substantially annular flow of liquid through each aperture and an annular liquid film about the tube passing through the aperture.

12. A condenser according to claim 11 wherein at least one of said apertures in each said distribution plate is defined in part by a radially inwardly directed flange of said distribution plate spaced radially outwardly of a tube therethrough defining an annular flow region about said tube.

* * * * *